US010161193B2

(12) United States Patent
Whiddon

(10) Patent No.: US 10,161,193 B2
(45) Date of Patent: Dec. 25, 2018

(54) PLUG FOR DOWNHOLE LOGGING TOOL

(71) Applicant: Scientific Drilling International, Inc., Houston, TX (US)

(72) Inventor: Richard Murray Whiddon, Porter, TX (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 237 days.

(21) Appl. No.: 14/699,862

(22) Filed: Apr. 29, 2015

(65) Prior Publication Data

US 2015/0315901 A1 Nov. 5, 2015

Related U.S. Application Data

(60) Provisional application No. 61/987,203, filed on May 1, 2014.

(51) Int. Cl.

| | |
|---|---|
| ***E21B 17/00*** | (2006.01) |
| ***E21B 49/00*** | (2006.01) |
| ***E21B 47/01*** | (2012.01) |
| ***E21B 47/12*** | (2012.01) |

(52) U.S. Cl.

CPC ..... *E21B 17/00* (2013.01); *E21B 47/01* (2013.01); *E21B 47/122* (2013.01); *E21B 49/00* (2013.01)

(58) Field of Classification Search

CPC ..... E21B 17/025; E21B 47/122; E21B 47/01; E21B 34/063; F16L 55/105

See application file for complete search history.

(56) References Cited

U.S. PATENT DOCUMENTS

| | | | | |
|---|---|---|---|---|
| 4,042,020 | A * | 8/1977 | Wellstein | E21B 33/00 166/85.2 |
| 4,883,085 | A * | 11/1989 | Weller | F16K 43/00 137/315.42 |
| 5,351,718 | A | 10/1994 | Barton | |
| 5,563,512 | A | 10/1996 | Mumby | |
| 5,927,340 | A | 7/1999 | Barton | |
| 6,349,778 | B1 * | 2/2002 | Blair | E21B 7/068 175/107 |

(Continued)

OTHER PUBLICATIONS

International Search Report and Written Opinion issued in International Application No. PCT/US15/28324, dated Aug. 5, 2015 (7 pages).

*Primary Examiner* — Cathleen R Hutchins
*Assistant Examiner* — Jonathan Malikasim
(74) *Attorney, Agent, or Firm* — Adolph Locklar

(57) ABSTRACT

A plug for use in a downhole tool collar allows a seal between the inside and outside of the collar. The plug provides an electromagnetically transparent window through which the signals from the measurement device may propagate to or from the surrounding formation. The plug assembly includes an inner retainer, an outer retainer, and a plug. The inner retainer may be inserted into the inside of a slot formed in the collar. The inner retainer may have a concave inner surface to match the cylindrical inner surface of the collar. Likewise, the outer collar may be inserted into the outside of the slot, and may have a convex outer surface to match the cylindrical outer surface of the collar. The plug may fit into slots in the inner and outer retainers and be held in place within the slot.

18 Claims, 8 Drawing Sheets

(56) References Cited

U.S. PATENT DOCUMENTS

| | | | | |
|---|---|---|---|---|
| 6,483,310 | B1 | 11/2002 | Meador | |
| 6,710,600 | B1 * | 3/2004 | Kopecki | E21B 47/01 175/320 |
| 6,975,243 | B2 | 12/2005 | Clark et al. | |
| 8,955,586 | B1 * | 2/2015 | Randa | E21B 47/01 166/250.11 |
| 9,103,197 | B2 * | 8/2015 | Purkis | E21B 33/0355 |
| 2006/0065394 | A1 * | 3/2006 | Clark | G01V 3/30 166/254.2 |
| 2008/0298925 | A1 | 12/2008 | Shinozaki | |
| 2011/0174385 | A1 * | 7/2011 | Drozd | A23L 3/005 137/13 |
| 2013/0056538 | A1 * | 3/2013 | Binmore | F16L 15/001 235/492 |

* cited by examiner

PLUG FOR DOWNHOLE LOGGING TOOL

CROSS-REFERENCE TO RELATED APPLICATIONS

This application is a nonprovisional application which claims priority from U.S. provisional application No. 61/987,203, filed May 1, 2014, the entirety of which is hereby incorporated by reference.

TECHNICAL FIELD/FIELD OF THE DISCLOSURE

The present disclosure relates generally to downhole tools, and specifically to fittings for downhole logging tools.

BACKGROUND OF THE DISCLOSURE

While drilling for underground hydrocarbon formations, many material properties may be logged to allow a driller to better understand the underground formation. Material properties may be determined utilizing electromagnetic waves emitted and received by a measurement device in a downhole tool. One such material property is resistivity. Resistivity measurement tools generally allow the driller to determine the resistivity or resistance to the conduction of electricity of the surrounding formation. By knowing the resistivity of the surrounding formation, an operator can make determinations about the makeup of the formation including, for example and without limitation, the presence or absence of water or hydrocarbons, as well as the porosity and/or permeability of the formation.

For some downhole tools which utilize electromagnetic waves, the measurement device is positioned within a tubular segment or collar referred to herein as a tool collar. The collar may be positioned as part of a tubular string including a plurality of tubular segments. By including the measurement device as part of the drilling string, measurements may be made during the drilling operation. In some tools, the measurement device is formed as a probe or sonde located within the collar. In other downhole tools, the measurement device may be coupled to but located within the collar. Unlike external antenna tools, in which the conductors are positioned on the exterior of the collar, a probe based tool or internally located tool may include antenna elements located internal to the collar.

Internal antenna tools may operate by transmitting an electromagnetic field through the formation between one or more transmitter antennae to one or more receiver antennae spaced apart along the tool string. One or more slots may be formed through the wall of the collar corresponding generally with the placement of each antenna of the probe. Because the collar is made of a conductive material, the electromagnetic field would be attenuated if not blocked altogether from entering the surrounding formation without the slots. Because of the necessity to maintain differential pressure between the interior and exterior of the tool string, the slots must be sealed with a resilient yet electromagnetically transparent plug. Probe based resistivity tools are discussed in more detail in U.S. Pat. No. 6,483,310, filed Oct. 17, 2000 ("Retrievable, formation resistivity tool, having a slotted collar"), the entirety of which is hereby incorporated by reference.

SUMMARY

The present disclosure provides for a plug assembly for plugging a slot having an inner edge and an outer edge formed in the wall of a tubular member. The plug assembly may include a plug including a plug body having an inner face and an outer face; an inner retainer, the inner retainer having a shape corresponding to the shape of the inner edge of the slot and an inner retainer slot corresponding to the shape of the inner face of the plug; and an outer retainer, the outer retainer having a shape corresponding to the shape of the outer edge of the slot and an outer retainer slot corresponding to the shape of the outer face of the plug, the outer retainer coupled to the inner retainer with the plug disposed therebetween.

The present disclosure also provides for a method of installing a plug assembly. The method may include forming a slot in the wall of a tubular member, the slot including an inner edge and an outer edge; installing an inner retainer within the inner edge of the slot, the inner retainer having a shape corresponding to the shape of the inner edge of the slot and an inner retainer slot corresponding to the shape of an inner face of a plug; installing the plug within the inner retainer slot, the plug including a plug body having the inner face and an outer face; installing an outer retainer within the outer edge of the slot, the outer retainer having a shape corresponding to the shape of the outer edge of the slot and an outer retainer slot corresponding to the shape of the outer face of the plug; and coupling the outer retainer to the inner retainer.

The present disclosure also provides for a system for the measurement of a parameter of a formation surrounding a wellbore. The system may include a collar, the collar being a generally tubular member, the collar including one or more slots, the slots including an inner edge and an outer edge. The system may also include a measurement device positioned within the collar, the measurement device including at least one energy transmitting or receiving antenna, each antenna positioned to generally correspond with at least one of the slots. The system may also include a plug assembly for plugging each slot. The plug assembly may include a plug including a plug body having an inner face and an outer face; an inner retainer, the inner retainer having a shape corresponding to the shape of the inner edge of the slot and an inner retainer slot corresponding to the shape of the inner face of the plug; and an outer retainer, the outer retainer having a shape corresponding to the shape of the outer edge of the slot and an outer retainer slot corresponding to the shape of the outer face of the plug, the outer retainer coupled to the inner retainer with the plug disposed therebetween.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
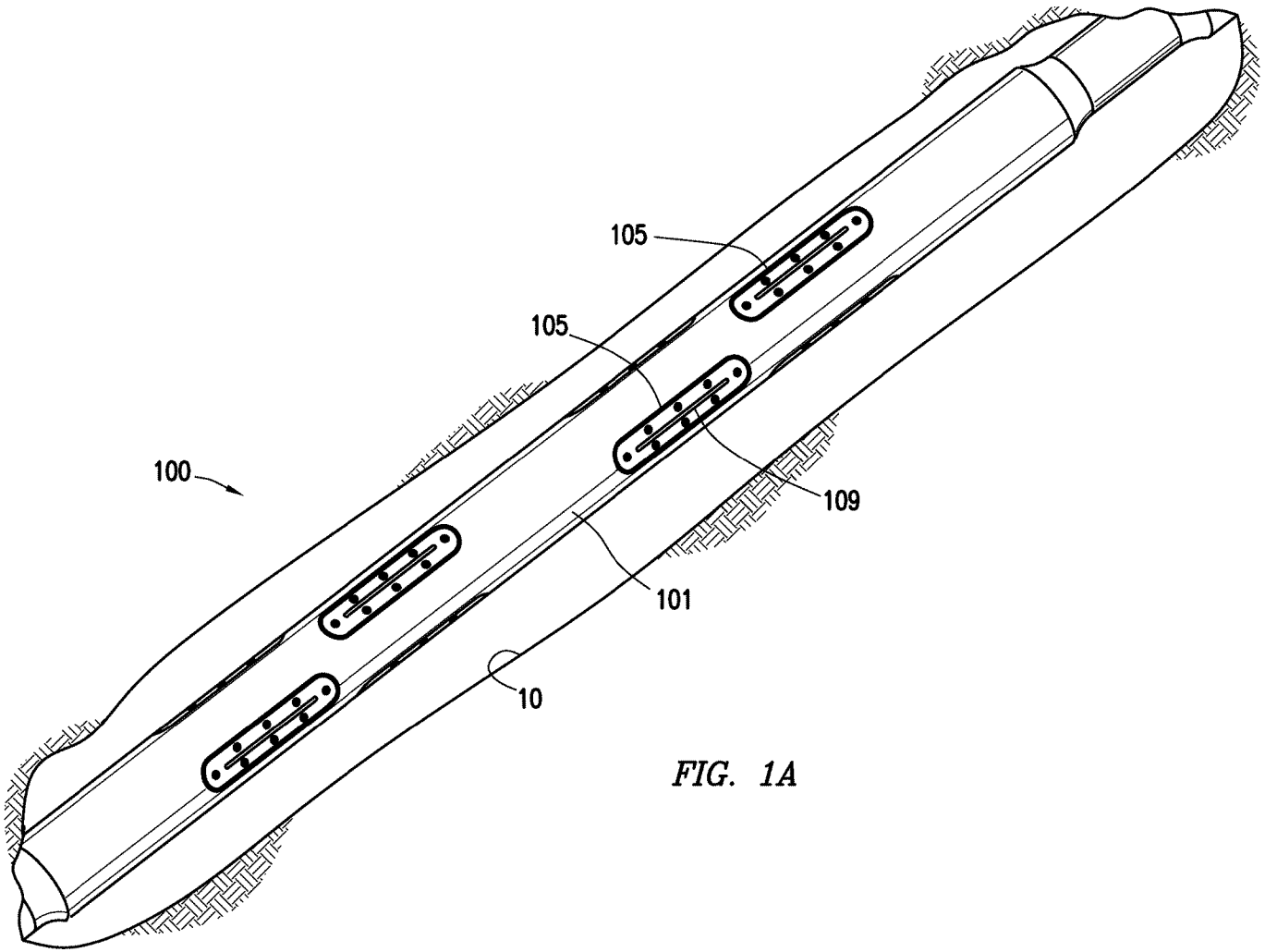
FIGS. 1A, B depict a tool collar consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIGS. 1A, B depict tool assembly 100 positioned within a wellbore 10, which includes tool collar 101 and measurement probe 103. Measurement probe 103 may include one or more measurement devices utilizing electromagnetic waves which may be used for, for example and without limitation, determining properties of surrounding formation 10. Although depicted as a probe based tool, one having ordinary skill in the art with the benefit of this disclosure will understand that the measurement devices utilized with tool assembly 100 may be collar mounted without deviating from the scope of this disclosure. Tool collar 101 includes a plurality of slots 105 formed therein and extending from the interior of tool collar 101 to the exterior of tool collar 101. Each slot 105 is positioned to generally correspond to an antenna 107 of measurement probe 103. Antennae 107 may, as understood in the art, be used for transmission or reception of electromagnetic signals passed therebetween. A Within each slot 105, collar plug assembly 109 is positioned.

Figure 2:
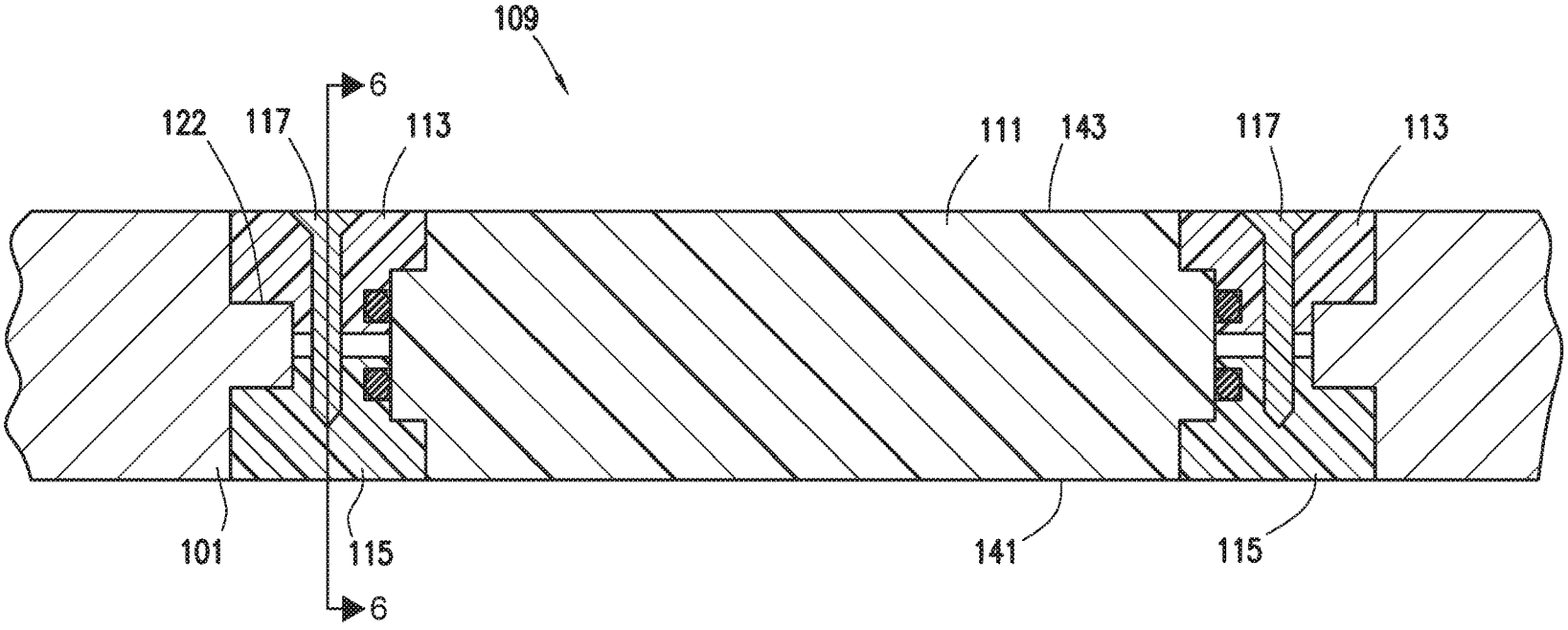
FIG. 2 is a cross section of a tool collar plug assembly positioned in a slot of the collar of FIGS. 1A, B.
Figure 3:
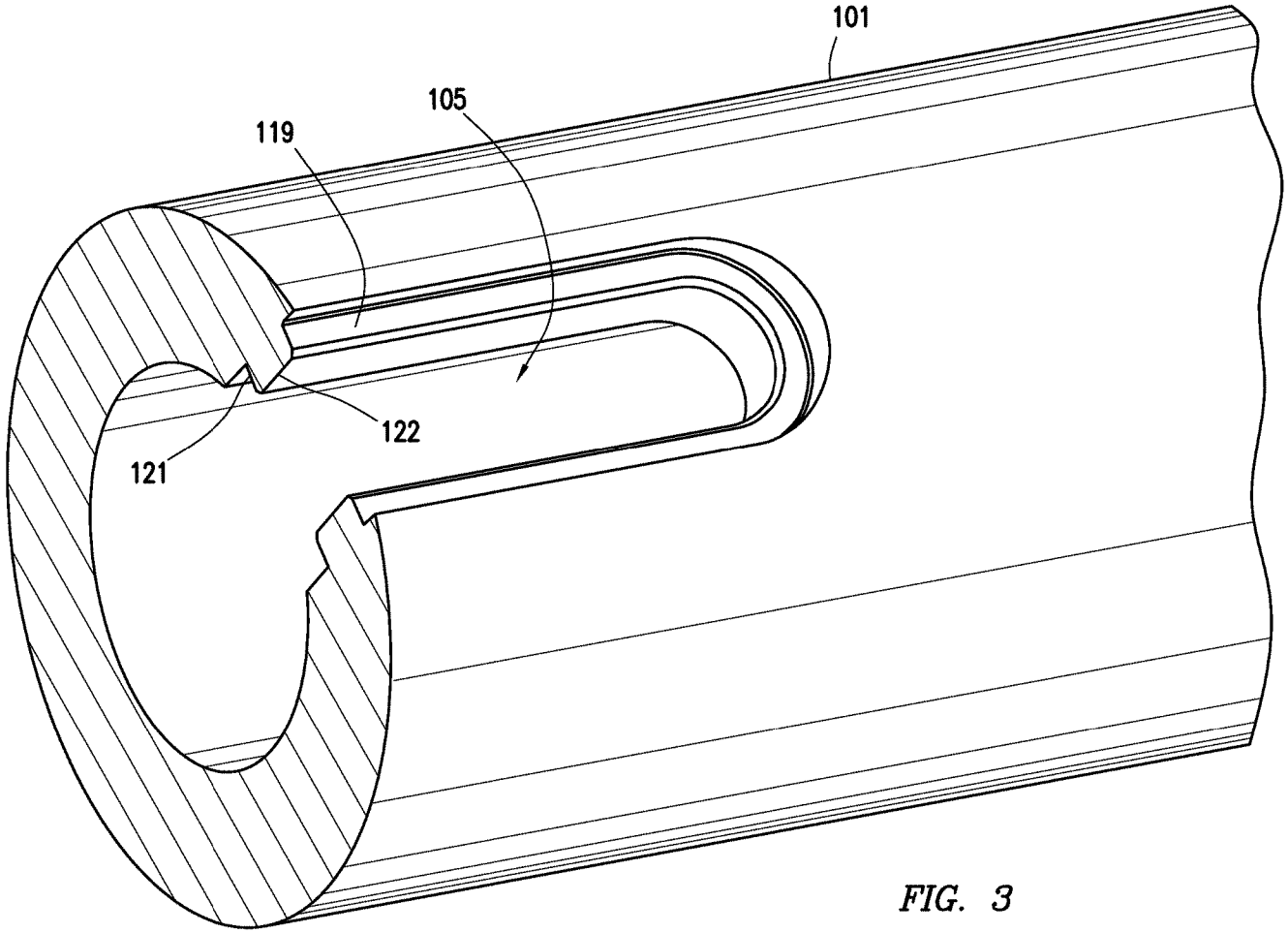
FIG. 3 is a cross-section view of a tool collar having a slot cut therein adapted to receive a tool collar plug assembly consistent with embodiments of the present disclosure.

With regard to FIG. 2, collar plug assembly 109 may include plug 111, outer retainer 113, and inner retainer 115. Outer and inner retainers 113, 115 may be coupled together by, for example and without limitation, threaded fastener 117 such as a screw or bolt. In some embodiments, slot 105 of tool collar 101 as depicted in FIG. 3, may be a generally linear slot with rounded or circular ends. In some embodiments, the rounded or circular ends of slot 105 may serve to, for example, reduce stress concentration in tool collar 101. Slot 105 may be formed by, for example, milling. One having ordinary skill in the art with the benefit of this disclosure will understand that any suitable method for forming slot 105 may be utilized without deviating from the scope of this disclosure.

In some embodiments, the profile of the wall of slot 105 may be formed about the entire perimeter of the slot with outer groove 119 and inner groove 121 to form clamping extension 122. In some embodiments, outer and inner grooves 119, 121 may be generally rectangular to form a generally rectangular clamping extension 122. As depicted in FIG. 2, clamping extension 122 may be adapted to mate with corresponding features of outer and inner retainers 113, 115 to, for example, allow outer and inner retainers 113, 115 to clamp to slot 105 of tool collar 101.

Figure 4:
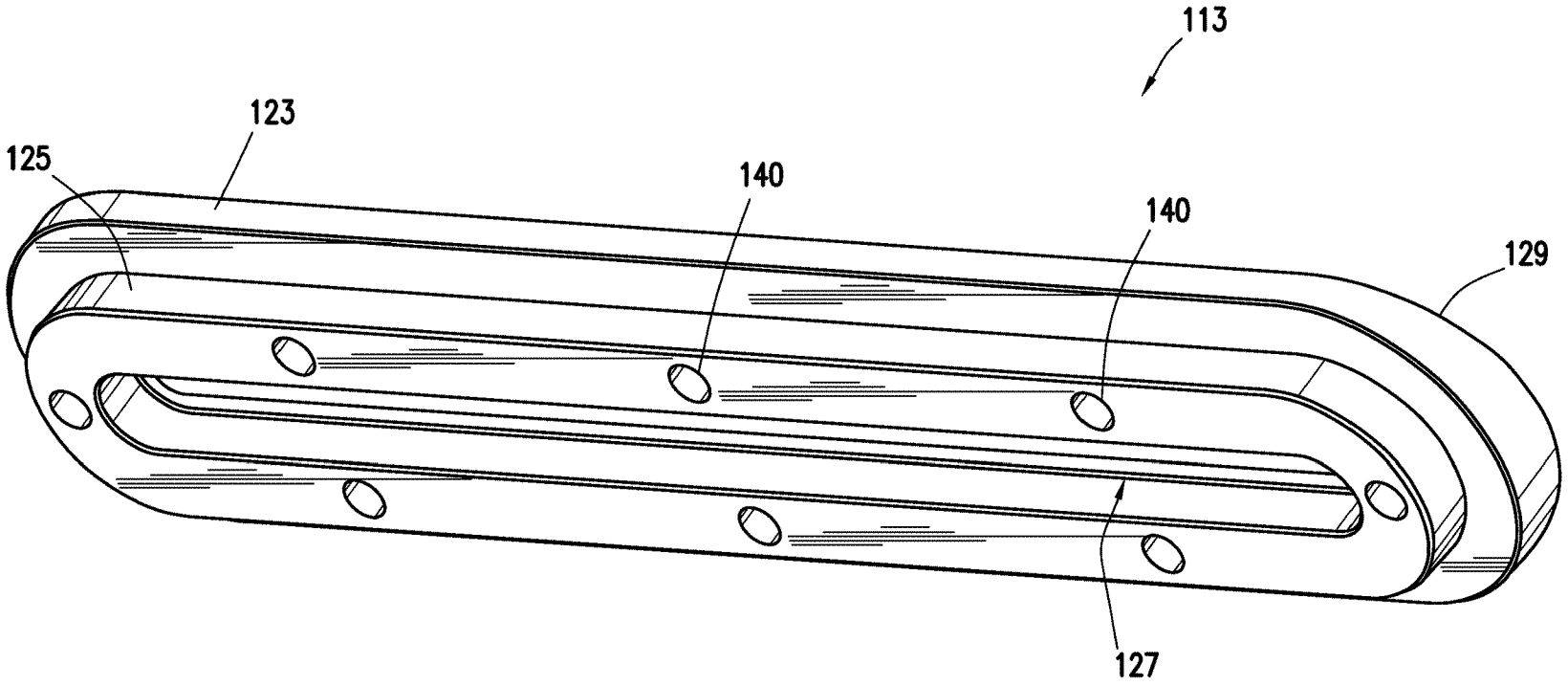
FIG. 4 is a perspective view of the outer retainer of the plug of FIG. 2.

As depicted in FIG. 4, outer retainer 113 may include outer cap 123, and internal boss 125. Outer cap 123 and internal boss 125 may be adapted to match closely with outer groove 119 and clamping extension 122 of slot 105 as previously discussed. Outer retainer 113 may also include outer retainer slot 127. Outer retainer slot 127 may be adapted to receive the outer edge of plug 111 as discussed below. In some embodiments, outer retainer 113 may include convex outer surface 129. Convex outer surface 129 may be configured to have the same radius of curvature as the outer surface of tool collar 101 so that when collar plug assembly 109 is installed in tool collar 101, the outer surface of tool assembly 100 forms a generally continuous, cylindrical surface.

Figure 5:
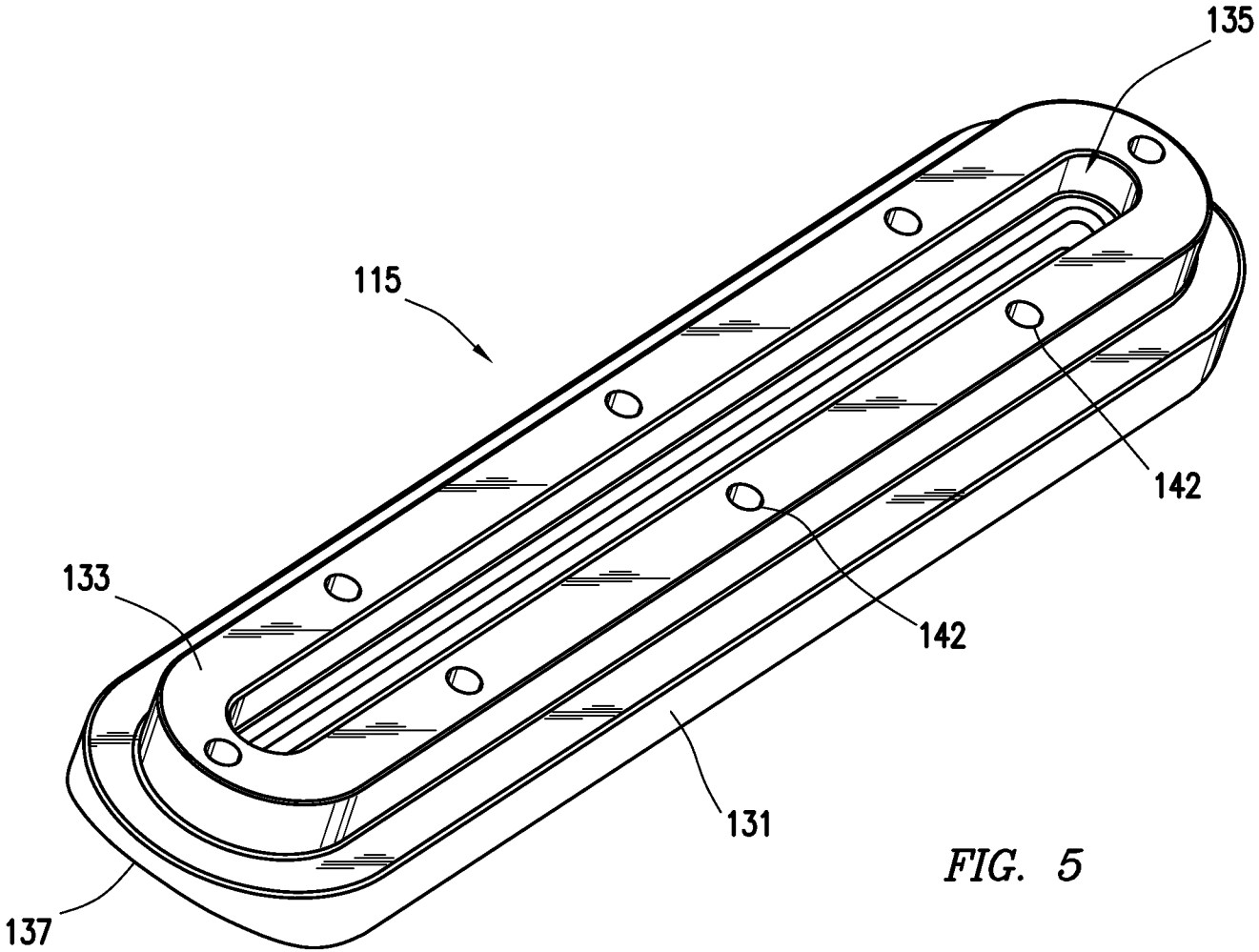
FIG. 5 is a perspective view of the inner retainer of the plug of FIG. 2.

As depicted in FIG. 5, inner retainer 115 may include inner cap 131 and external boss 133. Inner cap 131 and external boss 133 may be adapted to match closely with inner groove 121 and clamping extension 122 of slot 105 as previously discussed. Inner retainer 115 may also include inner retainer slot 135. Inner retainer slot 135 may be adapted to receive the inner edge of plug 111 as discussed below. In some embodiments, inner retainer 115 may include concave inner surface 137. Concave inner surface 137 may be configured to have the same radius of curvature as the inner surface of tool collar 101 so that when collar plug assembly 109 is installed in tool collar 101, the inner surface of tool assembly 100 forms a generally continuous, cylindrical surface.

Figure 6:
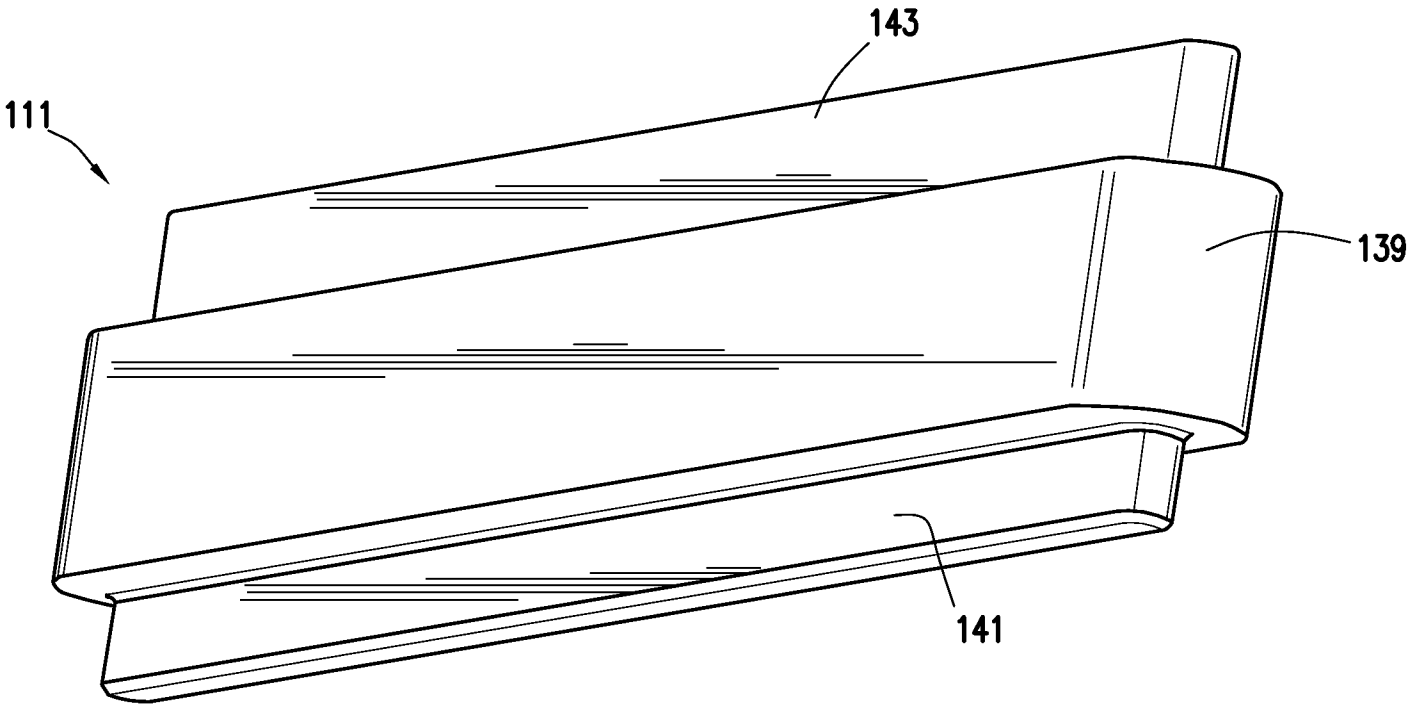
FIG. 6 is a perspective view of the plug of FIG. 2.

As depicted in FIG. 6, plug 111 may include plug body 139. In some embodiments, plug 111 may include internal extension 141 and external extension 143. Internal extension 141 may be formed as an extension from the interior surface of plug body 139 and may be adapted to correspond with the geometry of and couple to inner retainer slot 135 of inner retainer 115. Likewise, External extension 143 may be formed as an extension from the exterior surface of plug body 139 and may be adapted to correspond with the geometry of and couple to outer retainer slot 127 of outer retainer 113. In some embodiments, both outer retainer slot 127 and inner retainer slot 135 may include a flange adapted to retain plug body 139 between outer and inner retainers 113, 115 when collar plug assembly 109 is installed in tool collar 101. In some embodiments, the inner and outer surfaces of plug 111 may be concave and convex respectively to, for example, provide a smooth, generally continuous cylindrical inner and outer surface for collar plug assembly 109 when installed in tool collar 101.

In some embodiments, as depicted in FIGS. 2, 4, one or more outer fastener holes 140 may be formed in outer retainer 113, adapted to allow threaded fasteners 117 to be inserted therethrough. In some embodiments, as depicted in FIGS. 2, 5, one or more matching inner fastener holes 142 may be formed in inner retainer 115 positioned to receive threaded fasteners 117. In some embodiments, inner fastener holes 142 may be tapped to receive threaded fasteners 117. In some embodiments, inner fastener holes 142 may be of a smaller diameter than the threads of threaded fasteners 117, allowing threaded fasteners 117 to "self-tap" into inner retainer 115. In some embodiments, outer fastener holes 140 may further include a countersink or counterbore as understood in the art, adapted to allow the heads of threaded fasteners 117 to not protrude from the outer surface of outer retainer 113.

Figure 7:
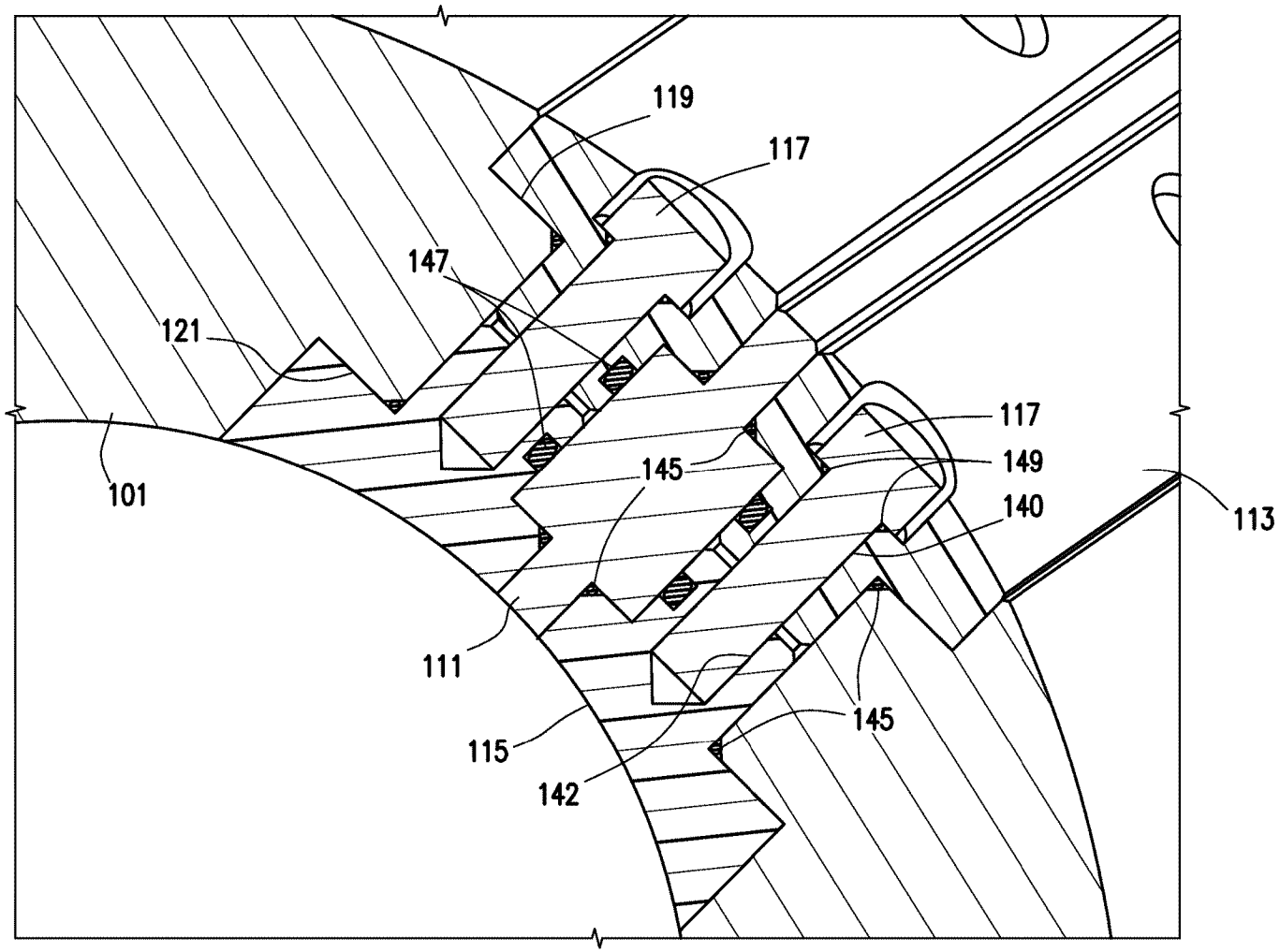
FIG. 7 is a cross section view of the tool collar plug assembly orthogonal to the cross section of FIG. 2 taken at line 6-6.

In some embodiments, as depicted in FIG. 7, one or more seals may be positioned between, for example and without limitation, plug 111 and outer or inner retainers 113, 115; tool collar 101 and outer or inner retainers 113, 115; and/or threaded fastener 117. Seals may be adapted to, for example, maintain the pressure differential between the interior and exterior of tool collar 101. In some embodiments, seals may include corner seals 145 as shown in FIG. 7. In some embodiments, seals may include seals positioned in grooves such as O-rings 147 or gasket seals. In some embodiments, seals may include bolt head seals 149 positioned between threaded fasteners 117 and outer retainer 113. In some embodiments, combinations of corner seals 145, O-rings 147, and bolt head seals 149 may be utilized. As understood by one having ordinary skill in the art with the benefit of this disclosure, seals may be located in alternate positions in addition to the locations shown in FIG. 7. As understood in the art, multiple seals may be utilized for redundancy. As understood in the art, during normal drilling operations, the differential pressure between the interior and exterior of tool collar 101 may vary. For example, during a trip-in operation in which the drilling string of which tool assembly 100 is a part is inserted into wellbore 10, the fluid pressure outside of tool collar 101 may be greater than the pressure within tool collar 101. Conversely, drilling fluid may be pumped through the drilling string and the interior of tool collar 101 at high pressure during drilling, causing the pressure within tool collar 101 to be greater than the pressure outside of tool collar 101 within wellbore 10. By including outer and inner grooves 119, 121 on slot 105 of tool collar 101, collar plug assembly 109 may remain in place within slot 105 regardless of the direction of pressure.

The components of collar plug assembly 109—collar plug 111, outer retainer 113, and inner retainer 115—may be formed from a material that is generally electromagnetically transparent to the electromagnetic field generated or received by antennae 107 of measurement probe 103. In some embodiments, the components of collar plug assembly 109 may be formed from an insulator material including for example and without limitation a polymer or rubber material. Additionally, the components of collar plug assembly 109 may be formed of a material having sufficient strength to withstand the differential pressures encountered during normal drilling operations. Furthermore, the components of collar plug assembly 109 may be formed of a material that is non-reactive with any fluids naturally or artificially present within wellbore 10 which may be encountered during a drilling operation.

Figure 1B:
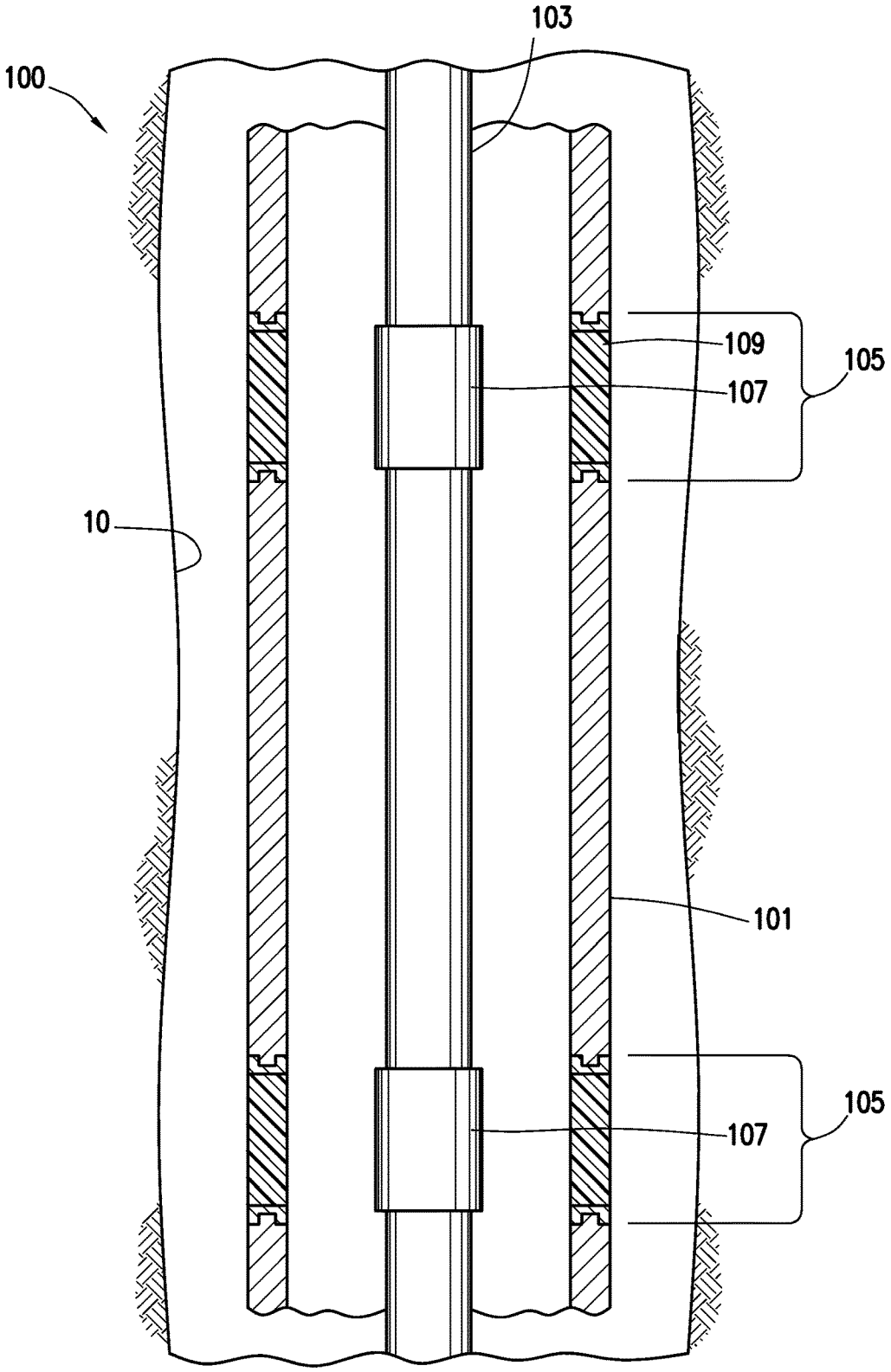

In order to assemble tool assembly 100, slots 105 are formed in a tubular segment to form tool collar 101. Slots 105, as previously discussed, may be positioned to generally correspond with the location of the one or more antennae 107 of measurement probe 103. One having ordinary skill in the art with the benefit of this disclosure will understand that in some embodiments, multiple slots 105 may be formed in tool collar 101 around each antenna 107. The number and geometry of slots 105 (including but not limited to slot length and width) may be varied to, for example, provide sufficient electromagnetic transparency for each antenna 107 while retaining sufficient structural strength for tool collar 101. Such determination may take into account, for example and without limitation, the diameter and wall thickness of tool collar 101. In some embodiments, three slots 105 may be formed to surround each antenna 107. Furthermore, although FIG. 1B depicts two antennae 107 located within a single tool collar 101, one having ordinary skill in the art with the benefit of this disclosure will understand that any number of antennae 107 may be located within tool collar 101. Additionally, a single tool assembly 100 may include any number of tool collars 101. In some embodiments, antennae 107 used as part of a single tool assembly 100 may be positioned within separate tool collars 101 which may not be contiguous within the drill string.

Slots 105 may be formed in tool collar 101 by any known suitable method of manufacture. Slots 105 may be formed in multiple steps using multiple methods of manufacture. In some embodiments, slots 105 may be formed by milling.

Once slot 105 is formed, inner retainer 115 may be inserted into inner groove 121 of slot 105. In some embodiments, inner retainer 115 may be inserted through slot 105. In other embodiments, inner retainer 115 may be inserted through the end of tool collar 101. In some embodiments, inner retainer 115 may be held into slot 105 using a tool inserted into the end of tool collar 101.

Collar plug 111 may then be installed into inner retainer 115. In some embodiments, as previously discussed, internal extension 141 may be inserted into inner retainer slot 135.

Outer retainer 113 may then be installed into slot 105. In some embodiments, as previously discussed, external extension 143 may be inserted into outer retainer slot 127 as outer retainer 113 is installed. Threaded fasteners 117 may then be inserted into outer fastener holes 140 and screwed into inner fastener holes 142.

In some embodiments, as collar plug assembly 109 is assembled in slot 105, one or more seals 145 may be installed as previously discussed, to, for example, enhance the fluid seal between the components of collar plug assembly 109. In some embodiments, an adhesive may be introduced between the components of collar plug assembly 109.

Once a collar plug assembly 109 is assembled in each slot 105 of tool collar 101, measurement probe 103 may be inserted into tool collar 101. In some embodiments, measurement probe 103 may be installed during the makeup operation of tool collar 101 into a drill string at the wellsite. In other embodiments, measurement probe 103 may be installed beforehand. In some embodiments, tool collar 101 may include threaded couplers as understood in the art adapted to allow tool collar 101 to be coupled to adjacent tubular segments in the drill string.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A plug assembly for plugging a slot having an inner edge and an outer edge formed in the wall of a tubular member comprising:

a plug including a plug body having an inner face and an outer face, the plug body being solid and consisting of a single material;

an inner retainer, the inner retainer having a shape corresponding to the shape of the inner edge of the slot and an inner retainer slot corresponding to the shape of the inner face of the plug, the inner retainer being annular such that the inner face of the plug is exposed to the interior of the tubular member when the plug assembly is installed to the wall of the tubular member; and an outer retainer, the outer retainer having a shape corresponding to the shape of the outer edge of the slot and an outer retainer slot corresponding to the shape of the outer face of the plug, the outer retainer being annular such that the outer face of the plug is exposed to the exterior of the tubular member when the plug assembly is installed to the wall of the tubular member, the outer retainer coupled to the inner retainer with the plug disposed therebetween;

wherein the plug, inner retainer, and outer retainer are each formed entirely from a generally electromagnetically transparent material.

2. The plug assembly of claim 1, wherein the inner face of the plug body comprises an internal extension, the internal extension adapted to fit into the inner retainer slot.

3. The plug assembly of claim 1, wherein the outer face of the plug body comprises an external extension, the external extension adapted to fit into the outer retainer slot.

4. The plug assembly of claim 1, wherein the inner retainer further comprises an external boss, the external boss adapted to fit into the slot.

5. The plug assembly of claim 1, wherein the outer retainer further comprises an internal boss, the internal boss adapted to fit into the slot.

6. The plug assembly of claim 1, wherein the inner retainer further comprises a concave inner surface, the concave inner surface having a radius of curvature generally corresponding with the inner radius of the tubular member.

7. The plug assembly of claim 1, wherein the outer retainer further comprises a convex outer surface, the convex outer surface having a radius of curvature generally corresponding with the outer radius of the tubular member.

8. The plug assembly of claim 1, wherein the inner and outer retainers are coupled together by at least one threaded fastener.

9. A method of installing a plug assembly comprising:

forming a slot in the wall of a tubular member, the slot including an inner edge and an outer edge;

installing an inner retainer within the inner edge of the slot, the inner retainer formed from a generally electromagnetically transparent material, the inner retainer having a shape corresponding to the shape of the inner edge of the slot and an inner retainer slot corresponding to the shape of an inner face of a plug, the inner retainer being annular such that the inner face of the plug is exposed to the interior of the tubular member when the plug assembly is installed to the wall of the tubular member;

installing the plug within the inner retainer slot, the plug including a plug body having the inner face and an outer face, the plug body being solid and consisting of a single electromagnetically transparent material;

installing an outer retainer within the outer edge of the slot, the outer retainer formed from a generally electromagnetically transparent material, the outer retainer having a shape corresponding to the shape of the outer edge of the slot and an outer retainer slot corresponding to the shape of the outer face of the plug, the outer retainer being annular such that the outer face of the plug is exposed to the exterior of the tubular member when the plug assembly is installed to the wall of the tubular member; and coupling the outer retainer to the inner retainer.

10. The method of claim 9, wherein the inner and outer edges of the slot are generally rectangular, and the slot further comprises a clamping extension.

11. The method of claim 10, wherein the inner retainer further comprises an inner cap and an external boss, the inner cap adapted to fit into the inner edge of the slot, and the external boss adapted to fit into the interior of the clamping extension.

12. The method of claim 10, wherein the outer retainer further comprises an outer cap and an internal boss, the outer cap adapted to fit into the outer edge of the slot, and the internal boss adapted to fit into the interior of the clamping extension.

13. The method of claim 9, wherein installing the inner retainer further comprises:

inserting the inner retainer through the slot;

orienting the inner retainer with the slot; and retaining the inner retainer within the slot as the plug is installed.

14. The method of claim 9, wherein coupling the outer retainer to the inner retainer further comprises:

inserting one or more threaded fasteners through one or more outer holes formed in the outer retainer and into one or more corresponding inner holes formed in the inner retainer;

screwing the one or more threaded fasteners into the inner holes.

15. The method of claim 9, further comprising:

installing one or more seals between two adjacent components of the plug assembly.

16. The method of claim 9, wherein the slots are formed at a position along the tubular member to generally correspond with the position of one or more antennae of an electromagnetic measurement device.

17. A system for measuring one or more parameters of a formation surrounding a wellbore utilizing electromagnetic waves, the system comprising:

a collar, the collar being a generally tubular member, the collar including one or more slots, the slots including an inner edge and an outer edge;

a measurement device positioned within the collar, the measurement device including at least one energy transmitting or receiving antenna, each antenna positioned to generally correspond with at least one of the slots; and a plug assembly for plugging each slot, the plug assembly including:

a plug including a plug body having an inner face and an outer face, the plug body being solid and consisting of a single electromagnetically transparent material;

an inner retainer, the inner retainer having a shape corresponding to the shape of the inner edge of the slot and an inner retainer slot corresponding to the shape of the inner face of the plug, the inner retainer being annular such that the inner face of the plug is exposed to the interior of the collar; and an outer retainer, the outer retainer having a shape corresponding to the shape of the outer edge of the slot and an outer retainer slot corresponding to the shape of the outer face of the plug, the outer retainer being annular such that the outer face of the plug is exposed to the exterior of the collar, the outer retainer coupled to the inner retainer with the plug disposed therebetween;

wherein the plug, inner retainer, and outer retainer are each formed entirely from a generally electromagnetically transparent material.

18. The system of claim 17, wherein the measurement device further comprises:

one or more electromagnetic energy transmitting antennae positioned proximate to and radially inward from a first one or more slots; and one or more electromagnetic energy receiving antennae positioned proximate to and radially inward from a second one or more slots.

* * * * *